US006209362B1

(12) United States Patent
Speich

(10) Patent No.: US 6,209,362 B1
(45) Date of Patent: Apr. 3, 2001

(54) WARP KNITTING MACHINE, ESPECIALLY CROCHETING MACHINE

(75) Inventor: Francisco Speich, Bleumattstrasse (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/463,150

(22) PCT Filed: Jul. 2, 1998

(86) PCT No.: PCT/CH98/00288

§ 371 Date: Jan. 19, 2000

§ 102(e) Date: Jan. 19, 2000

(87) PCT Pub. No.: WO99/05351

PCT Pub. Date: Feb. 4, 1999

(30) Foreign Application Priority Data

Jul. 25, 1997 (CH) ..... 1798/97

(51) Int. Cl.[7] ..... D04B 23/00

(52) U.S. Cl. ..... 66/207; 66/204; 66/85 R

(58) Field of Search ..... 66/203, 204, 207, 66/208, 84 R, 85 R, 125 R, 133, 135

(56) References Cited

U.S. PATENT DOCUMENTS 4,145,897 * 3/1979 Villa ..... 66/207
5,544,500 * 8/1996 Speich ..... 66/207

FOREIGN PATENT DOCUMENTS 275 84 21 6/1978 (DE) .
2758421 * 6/1978 (DE) ..... 66/207
302 20 86 1/1981 (DE) .
3022086 * 1/1981 (DE) ..... 66/207
301-19 63 10/1981 (DE) .
3011963 * 10/1981 (DE) ..... 66/207
9423106 * 1/1981 (WO) ..... 66/207
WO94/23106 10/1994 (WO) .

* cited by examiner

*Primary Examiner*—Danny Worrell
(74) *Attorney, Agent, or Firm*—Hovey, Williams, Timmons & Collins

(57) ABSTRACT

The invention relates to a warp knitting machine, especially a crocheting machine, comprising knitting needles guided on a knock-over sinker with warp thread layers which are fitted upstream with warp thread guides and weft thread layer rods assigned to weft thread guides. The invention provides an improvement to a warp knitting machine, characterized in that the weft thread guides of the weft thread layer rods do not cross the knitting needles and the weft thread guides of the weft thread layer rods are assigned feeding means relative to the knitting needles, which can be guided and driven upwards and downwards between the weft thread guides and the knitting needles in such a way that the feeding means place staggered weft threads underneath the assigned knitting needles.

15 Claims, 6 Drawing Sheets

50a
48a
44a
42a
40a
38a
36a
66a
W
78
62a
52a
68a
34a
80
82
32a
70a
48a
40a
44a
36a
62a
64a
78
50a
76
34a
32a

WARP KNITTING MACHINE, ESPECIALLY CROCHETING MACHINE

TECHNICAL FIELD

The invention relates to a warp knitting machine, especially a crochet galloon machine, having knitting needles which are guided on a knock-over bar and which include warp guide bars having warp guides and weft guide bars having and weft guides.

PRIOR ART

A warp knitting machine of the type mentioned in the introduction is known, for example, from DE-A-27 58 421. In this warp knitting machine, the weft guide bars and the weft guides arranged thereon must be moved not only to and fro along the weft guide bars, but also up and down, in order to underlay a corresponding weft yarn on a knitting needle. In this case, the weft guide bars are exposed to a very high dynamic load, thus resulting in sagging, wear and high noise emission. In order to counteract this, the bars must have a very large cross-section and therefore require a large amount of space. This space requirement, on the one hand, and the only limited free space available on the warp knitting machine, considerably restrict the maximum number of weft guide bars, for example to eight. An improvement to a maximum of sixteen can be achieved by improving the design according to WO 94/23 106. In this case, two weft guide bars are designed so as to be one above the other and so as to engage one into the other. In this design too, there are still the disadvantages that the weft guide bars have to be moved not only to and fro but also up and down, so that high inertia forces, strong vibrations, high noise emission and wear occur. The maximum speed of such warp knitting machines is therefore restricted, for example to 1200 revolutions/minute. In addition, in view of the fact that an ever smaller needle gauge of four to ten needles per cm is demanded nowadays, the knitting needles have very thin cross-sections, with the result that the needles are highly susceptible to flexions and oscillations. At the present time, it is customary to restrict the maximum free knitting needle length to approximately 50 times the needle thickness in the gauge direction. The warp yarns are inserted into the knitting needle heads when the needles are in the extended position. The distance between the knock-over bar and this extended position is available for the number of racking rows for weft guidance and, at the present time, amounts to a maximum of seven rows. Yarn guides having tips or having small end tubes serve for laying the weft yarns under and between the knitting needles. Furthermore, the tip of the yarn guide may also be provided with a small end tube which, however, takes up a relatively large amount of space. The racking gauge is therefore nowadays, on average, approximately 3 mm. This restricts the number of racking levels to seven, on the assumption of a knitting needle stroke of 25 to 30 mm. Also because up to seven yarn guide tips, which have to engage into a knitting needle gap between the knitting needles, cannot be oriented exactly in one line, there is contact with the knitting needles, and these begin to vibrate or may be damaged, thus impeding insertion of the warp yarns in the knitting needle heads and greatly restricting the rotational speed of warp knitting machines.

Since, on the one hand, the yarn guides for laying the weft yarns under the knitting needles have to penetrate into the knitting needle gaps and since, on the other hand, the guidance of weft yarns over long distances is driven via a crank mechanism, a certain number of knitting needles must be omitted at the reversal point of the yarn guide. This affords the disadvantage that the useful knitting length is reduced or that weft guidance must be driven via cam mechanisms, thus, in turn, restricting the maximum rotation speed of warp knitting machines.

According to the prior art, the knitting point is designed on the crochet galloon principle, as a result of which it is not possible for the yarns to be beaten up on the selvedge. This affords the disadvantage that it has hitherto been possible to produce only knitted fabrics having a relatively low weft density. The area of use of warp knitting machines is thereby restricted.

SUMMARY OF THE INVENTION

The object of the invention is to improve a warp knitting machine of the type mentioned in the introduction.

The set object is achieved by means of the provision of weft guides which do not cross through the knitting needles and the assignment of feeders to the weft guides, which feeders are guided and can be driven up and down between the weft guides and the knitting needles transversely to the racking direction of the weft guide bars. This enables the feeders to lay racked weft yarns under the associated knitting needles Since the weft guides of the weft guide bars do not intersect the knitting needles, they also do not have to be moved up and down, a to-and-fro movement instead being sufficient. The weft yarns are supplied to the knitting needles by the feeders. This results in an appreciable simplification of the weft guide and of the weft guide bars, so that a very large, hitherto impractical number of weft guide bars and weft guides is possible. The number of racking rows is also no longer necessarily restricted, so that the maximum possible number is equal to the number of installed weft guide bars. Furthermore, the knitting needle stroke can be reduced to a minimum size, since there need only be space for a single feeder in a knitting needle gap between the knitting needles. The knitting needle stroke is therefore essentially dependent on the width of the feeder. Since the weft guides no longer enter the knitting needle gaps between the knitting needles, operation is possible with weft guidance of virtually any length, without any loss of knitting needles. This may be further assisted by using electronically controlled drives for driving the weft guide bars, the said drives allowing smooth motion so as to treat the weft yarns carefully.

Advantageous embodiments of the invention are further described herein.

It is possible in principle for the weft guide bars to execute not only a to-and-fro movement, but also a movement transverse to this, provided, however, that the weft guides do not intersect the knitting needles. It is more advantageous, however, if the weft guide bars and therefore also the weft guides execute only a to-and-fro movement in their longitudinal direction, thereby appreciably simplifying the drive and mounting, so that a larger number of weft guide bars and consequently weft guides may be used. It is also advantageous if the knitting needles execute only a to-and-fro movement along their knitting axis.

It is possible in principle for not every knitting needle to be assigned a feeder, but the embodiment wherein each knitting needle is assigned a feeder is more advantageous.

It is conceivable that the feeders do not cross through the weft guides of the weft guide bars and the knitting needles, but run at a distance from these. However, an embodiment wherein the feeders cross through the weft guides of the weft guide bars and the knitting needles in a finger-like manner is especially advantageous, the result of this being that not only is a more compact design achieved, but the operating capacity of the warp knitting machine is also increased.

The feeders may, if appropriate, be driven individually or in groups, but an embodiment wherein the feeders are arranged on a common, drivable on a common feeder bar is more advantageous.

The feeders may be movable along a straight path and/or along arcuate paths. Especially advantageous is a design wherein the return travel of the feeder from the knitting point is arranged at a distance from the weft guides, which makes it possible for the return travel of the feeders to lie outside the weft guides, so that racking of the weft guide bars can take place as early as during the return travel of the feeders.

As regards the arrangement of the weft guide bars together with the weft guides, various possibilities arise, such as, for example, wherein the weft guide bars together with the weft guides are arranged in such a way that the weft yarns are supplied to the knitting point by the weft guides essentially in the same direction as the warp yarns, or where the weft guides are arranged in such a way that the weft yarns are supplied to the knitting point by the weft guides in the opposite direction to the warp yarns.

An advantageous arrangement of the weft guide bars is provided where they are arranged in such a way that the mouths of the weft guides are arranged along a straight or arcuate surface relative to the knitting point.

Various possibilities arise for the design of the feeders such as the provision of a downwardly open fork-shaped head on the feeders for grasping the weft yarns. The development wherein the feeders have guide elevations on each of the two sides on a head engaging into the knitting needle gap between the knitting needles improves the stability and operating reliability of the feeders. A development wherein the feeders are designed in such a way that they press or beat up the weft yarns onto the selvedge of the knitted fabric after crossing through the knitting needles is also especially advantageous, the result of this being that a close-packed knitted fabric can be produced.

Various possibilities arise as regards the drive of the weft guide bar and/or of the warp guide bar. The possibility wherein the weft guide bars can each be driven by means of an electrical actuator which can preferably be controlled by means of an electronic control device is especially preferred, since an electronically controlled actuator constitutes, for each guide bar, an effective drive which takes up little space and can be controlled in a simple way, both as regards the timing and as regards the stroke size, according to a predeterminable pattern for producing the knitted fabric.

The embodiment wherein the magnitude of the up-and-down movement of the feeders is adjustable is also especially advantageous, according to this the magnitude of the up-and-down movement of the feeders being adjustable.

BRIEF DESCRIPTION OF THE DRAWINGS

Exemplary embodiments of the invention are described in more detail below with reference to the diagrammatic drawings in which.

DESCRIPTION OF THE PREFERRED EMBODIMENTS

Figure 1:
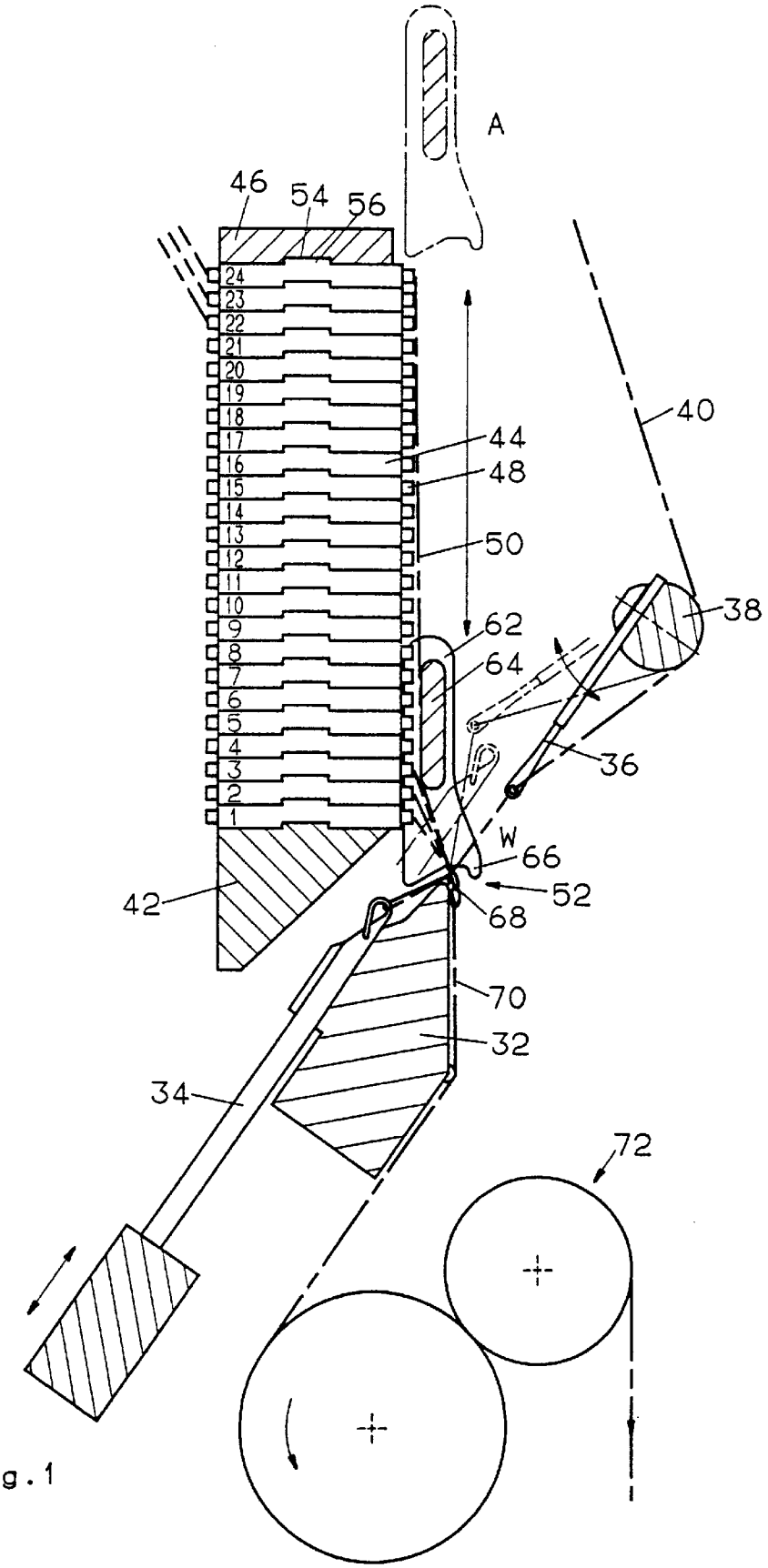
FIG. 1 shows a vertical section through a first warp knitting machine, with the feeder raised.
Figure 2:
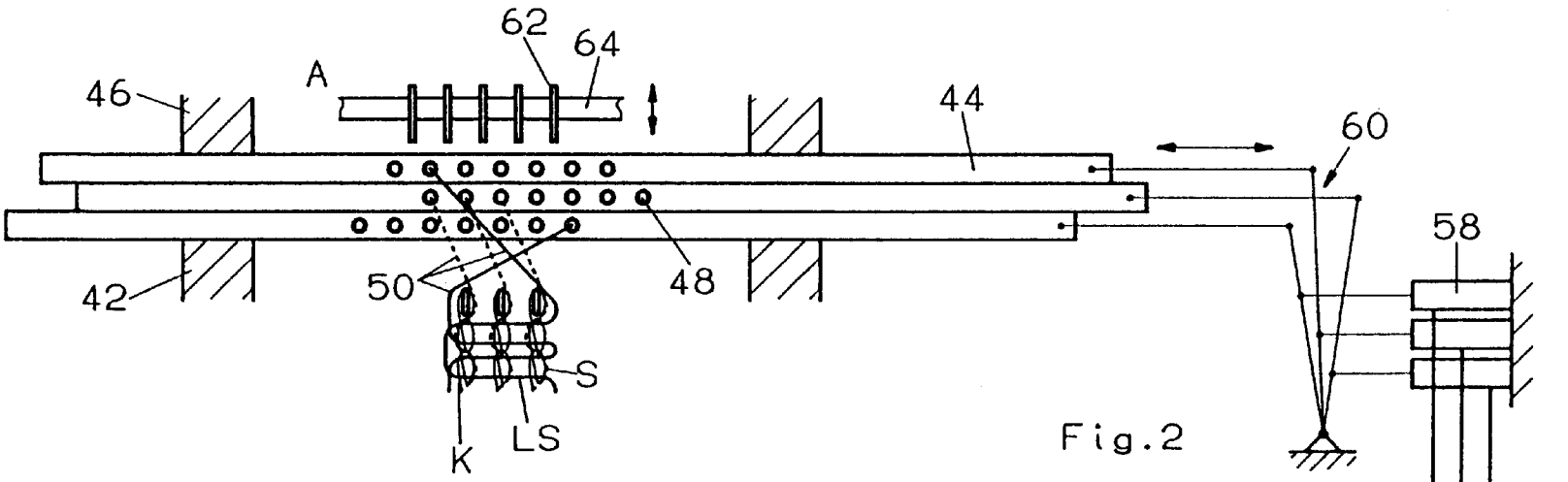
FIG. 2 shows, as a detail, the warp knitting machine of FIG. 1, with the feeder in the initial position, in a view towards the weft guide bars.
Figure 3:
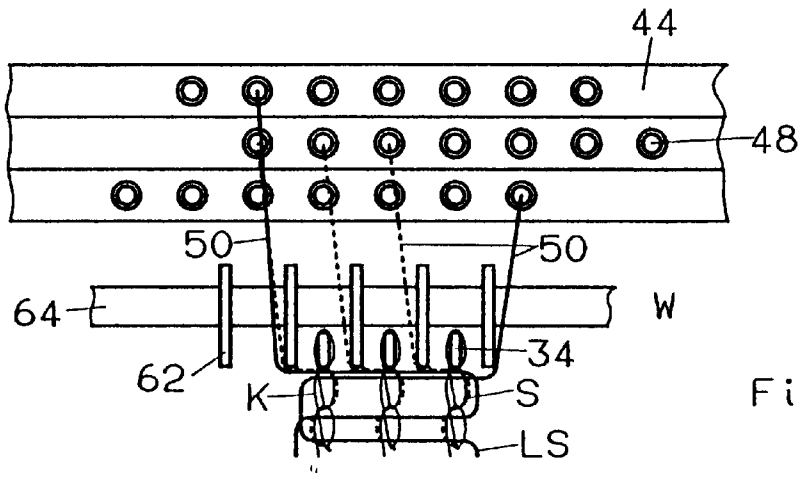
FIG. 3 shows, as a detail and on a larger scale, the warp knitting machine of FIG. 2, with the feeder at the knitting point, in a view towards the weft guide bars.

FIGS. 1 to 3 show a first exemplary embodiment of a warp knitting machine which has knitting needles 34 which are guided and driven back and forth in their longitudinal direction in a knock-over bar 32 and which are preceded by warp guides 36. The warp guides 36 are fastened to a warp guide bar 38 and execute a movement about the knitting needles 34, in order, in each case, to insert a warp yarn 40 into a knitting needle 34 when the latter is in the foremost position, as indicated by broken lines in FIG. 1. In this exemplary embodiment, the knitting needles 34 are designed as spring-hook needles and are driven in a known way not illustrated in any more detail.

Figure 4:
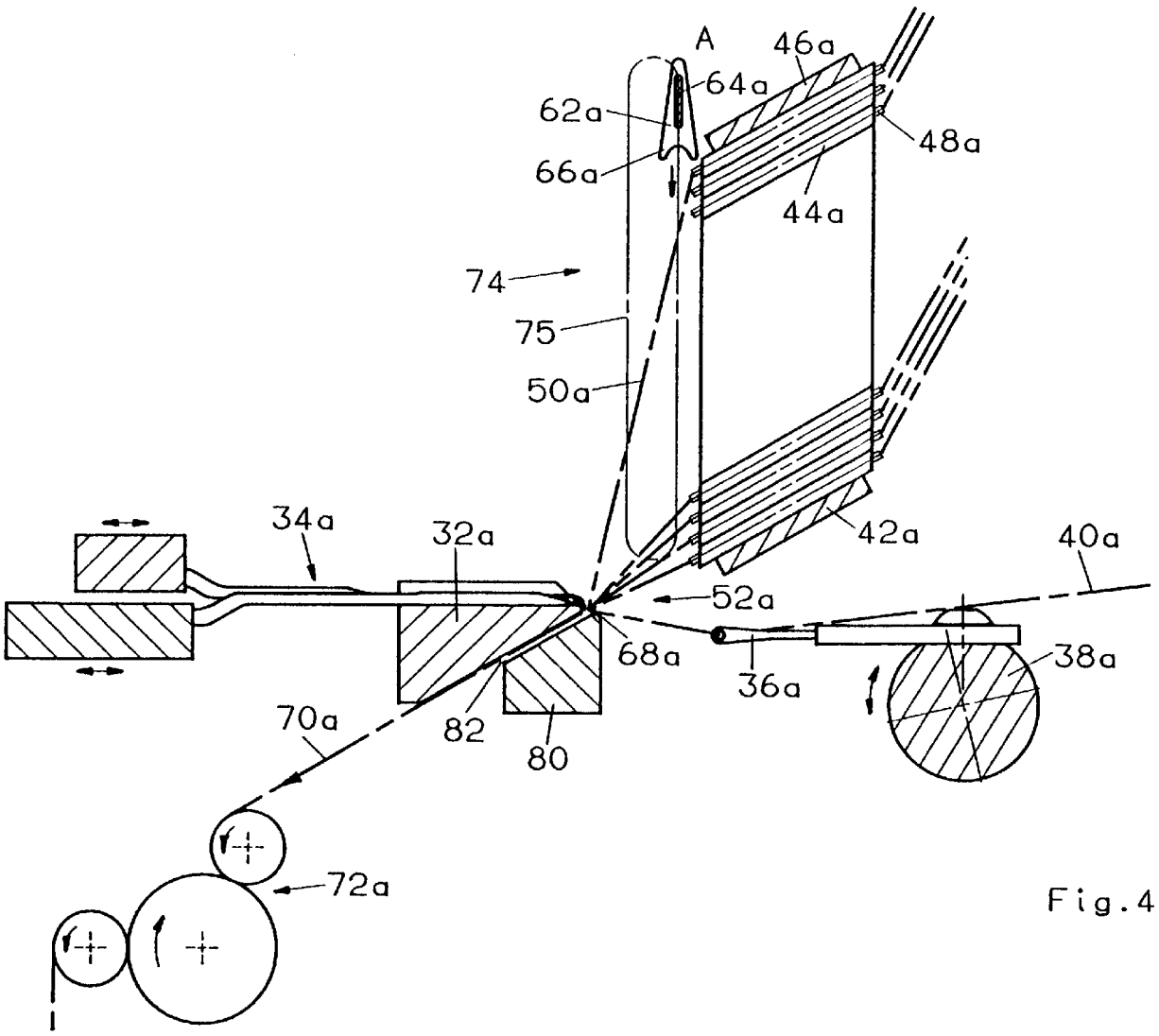
FIG. 4 shows a vertical section through a further warp knitting machine, with the feeder in the initial position.

A stack of weft guide bars 44 bearing the numbers 1 to 24 is arranged above the knitting needles 34 on a carrier 42 and is held on the topside by a guide 46. Each weft guide bar 44 contains a row of weft guides 48 in the form of small tubes, in order to supply weft yarns 50 to the knitting point 52. For the mutual guidance of the weft guide bars 44, there are, for example, grooves 54, into which tongues 56 of the adjacent components engage. As emerges especially from FIGS. 3 and 4, the individual weft guide bars 44 are individually driven to and fro, solely in the longitudinal direction, by means of individual actuators 58, for example electrically driven linear motors, via corresponding gears 60. These actuators 58 are connected to an electronic computer-assisted control device 61 which controls the use and/or stroke of the actuators 58 according to the particular pattern.

For supplying the individual weft yarns 50 to the knitting point 52, there are feeders 62 arranged on a feeder bar 64 which can be moved, in a way not illustrated in any more detail, up and down out of the initial position A represented by broken lines into the knitting position W represented by unbroken lines. The feeders have a fork-like head 66 and, after the weft guides 48 have been racked, pass through the latter in a finger-like manner, in order to carry the respectively racked weft yarns to the knitting point 52 and lay them under the knitting needles 34, before the latter are moved out of the retracted position into the advanced position (represented by broken lines in FIG. 1). During the feed, the feeders 62 move right up to the selvedge 68, with the result that it is possible to produce a very close-packed knitted fabric 70 which is drawn off from the knitting point 52 by a draw-off device 72.

By means of the weft guide bars 44 bearing the numbers 1 to 24 and their weft guides 48, it is possible to use weft yarns 50 of the most diverse types, such as, for example, having different thickness, twisting, materials (such as rubber yarns), but also different make-up, for example as regards colour, shading and fleeciness. At the same time, such weft yarns may, for example, be laid as a stem S in only one warp K or as a part weft over some of the width or as a long weft LS over the entire width of the knitted fabric 70.

FIGS. 4 to 7 illustrate a further exemplary embodiment of a warp knitting machine which corresponds essentially to that of FIGS. 1 to 3, so that identical parts are given the same reference symbols, but with the addition of the index a.

In contrast to the warp knitting machine of FIGS. 1 to 3, that in FIGS. 4 to 7 is modified particularly to the effect that the weft guide bars 44*a* together with the weft guides 48*a* are arranged in such a way that the weft yarns 50*a* are supplied to the knitting point 52*a* by the weft guides 48*a* essentially in the same direction as the direction of the warp yarns 40*a* supplied by the warp guides 36*a*. The feeders 62*a* on the feeder bar 64*a* are arranged on a rotating drive device 74, not illustrated in detail, in such a way that they are moved downwards out of the initial position A illustrated in FIG. 4, at the same time combing through the weft guides 48*a* in a finger-like manner, into the knitting position W at the knitting point 52*a*, as illustrated especially in FIGS. 5 and 6. In this position, they lay the carried-along weft yarns 50*a* behind the knitting needles 34*a* which, in the present example, are designed as compound needles. To guide the feeders 62*a* back out of the knitting position, they are moved forwards out of the region of the weft guides 48*a* by means of the drive device 74 and pass, free of the weft guides 48*a*, into the initial position A by way of the return travel 75. As early as during this return movement, the weft guide bars 44*a* can be racked again according to the particular pattern, so that the performance of the warp knitting machine can be improved thereby.

Figures 5, 6:
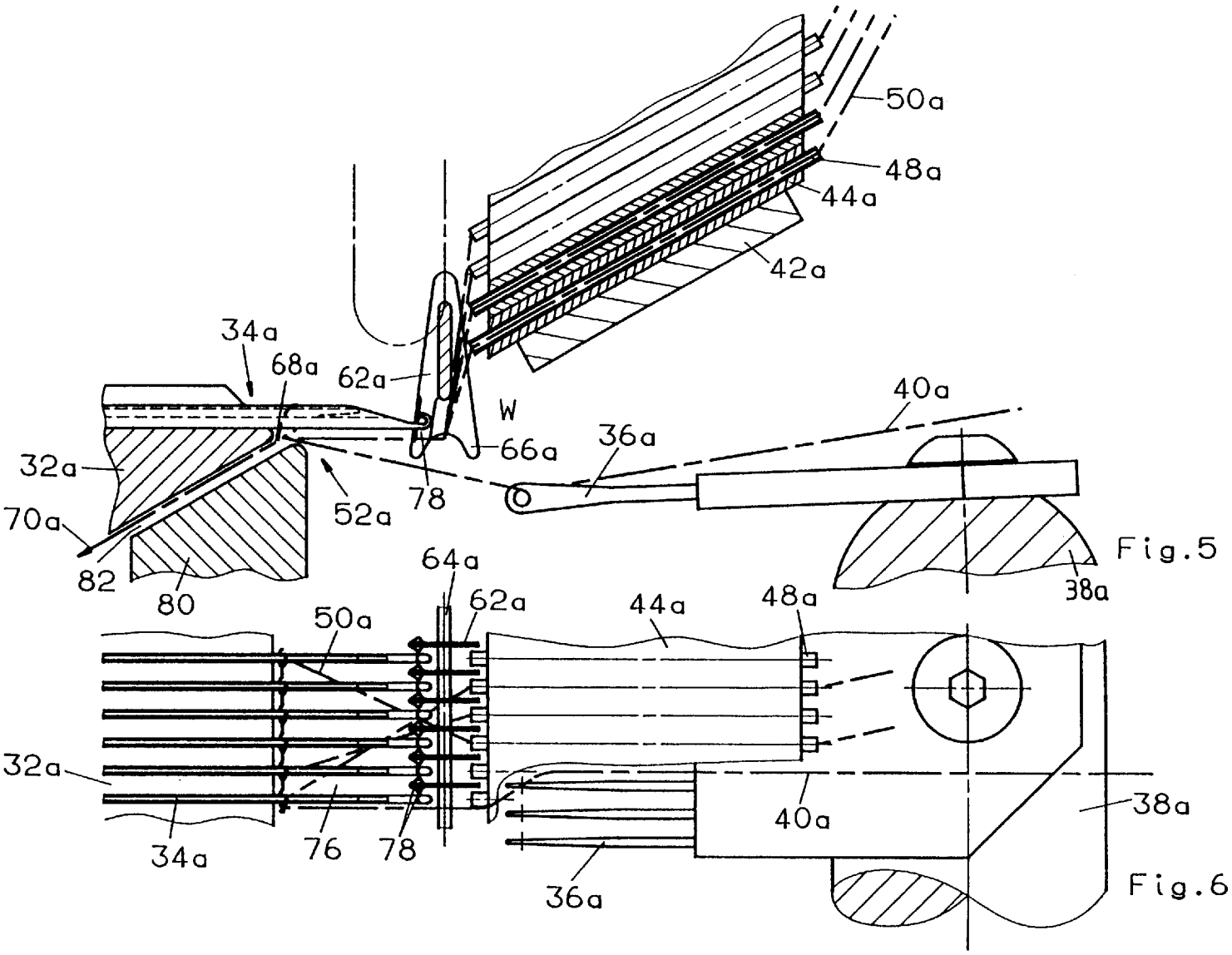
FIG. 5 shows, as a detail and on a larger scale, the warp knitting machine of FIG. 4, with the feeder at the knitting point.
FIG. 6 shows a plan view of the warp knitting machine of FIG. 5.
Figure 7:
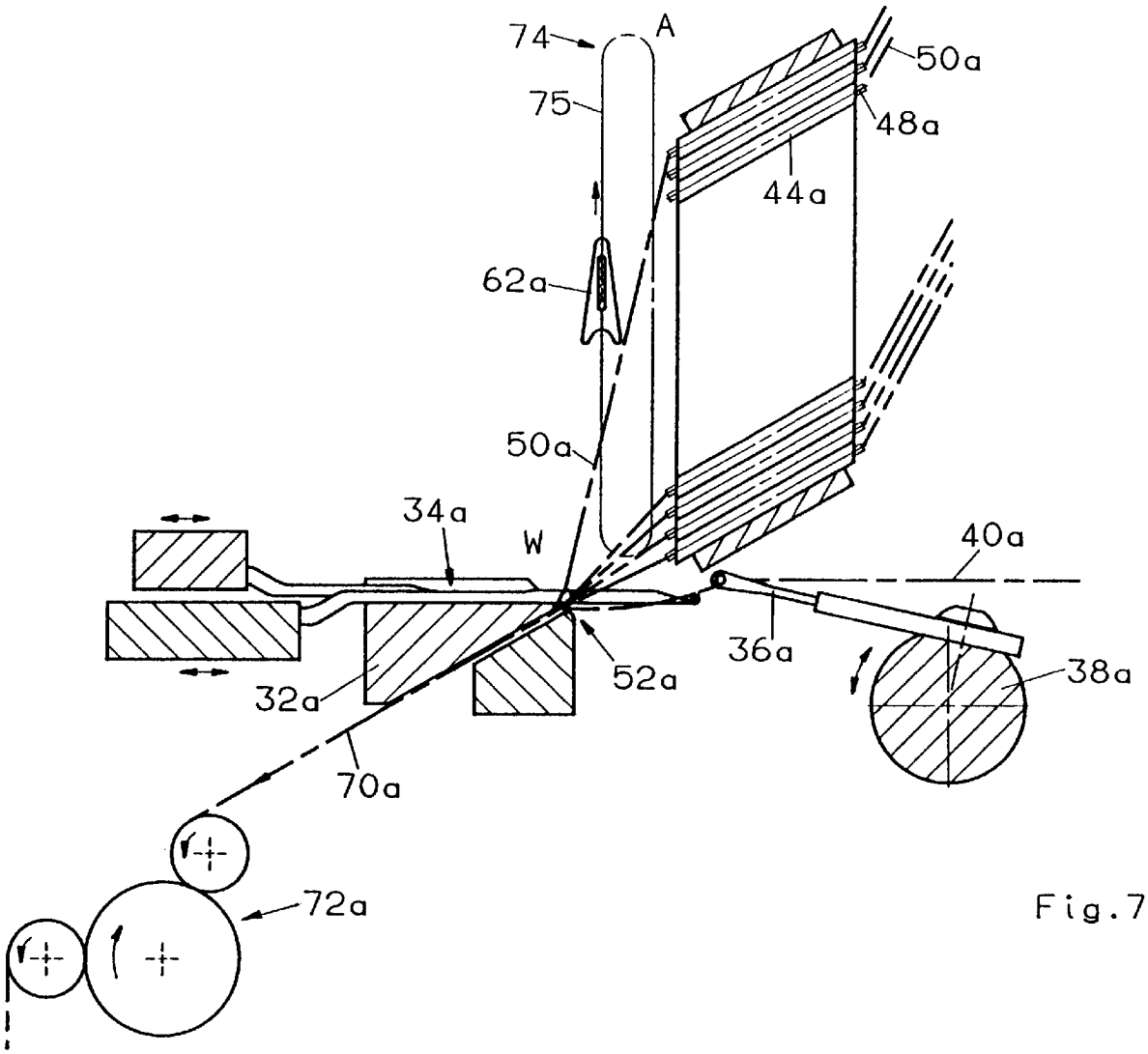
FIG. 7 shows the warp knitting machine of FIG. 4, with the feeder on its return travel.

As emerges especially from FIGS. 5 and 6, the feeders 62*a* have, once again, a fork-shaped head 66*a* which is provided with guide elevations 78 on the part penetrating into the knitting needle gap 76 between the knitting needles 34*a*, in order, on the one hand, to make it easier for the feeders 62*a* to penetrate into the knitting needle gaps 76 and, on the other hand, to keep the knitting needles 34*a* at a distance from one another.

The warp knitting machine of FIGS. 4 to 7 is, further, modified to the effect that the weft guide in bars 44*a* and consequently also the weft guides 48*a*, together with the carrier 42*a* and guide 46*a*, are arranged at an inclination to the horizontal such that the weft yarns 50*a* make it possible to have as unimpeded a run-through to the knitting point 52*a* as possible. Moreover, the knock-over bar 32*a* is assigned a panel holder 80 which forms with the knock-over bar a guide clearance 82 of the knitted fabric 70*a* which is drawn off by the draw-off device 72*a*.

Figure 8:
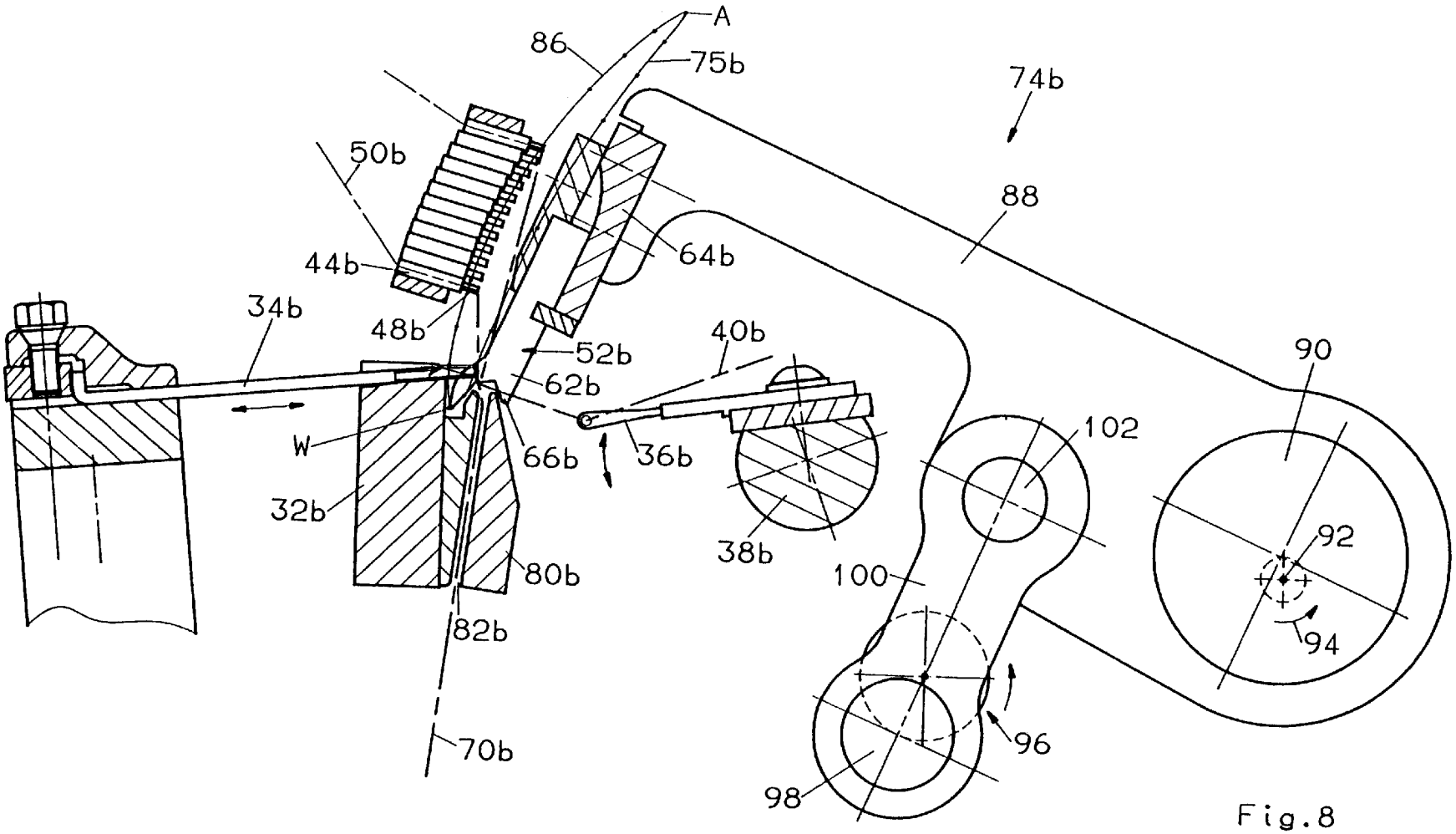
FIG. 8 shows a vertical section through a further warp knitting machine, with the weft guide bar arranged along an arcuate surface.

FIG. 8 shows a further warp knitting machine which corresponds in functional terms to the above warp knitting machines of FIGS. 1 to 7, so that identical parts are given the same reference symbols, but with the addition of the index b.

The knitting needles 34*b* arranged in the knock-over bar 32*b* are preferably designed as spring-hook needles. The knock-over bar 32*b* is assigned a panel holder 80*b* which forms with the latter a guide clearance 82*b*. The knitting needles 34*b* are preceded by warp guides 36*b*, arranged on a warp guide bar 38*b*, for the supply of warp yarns 40*b*.

The weft guide bars 44*b* together with the weft guides 48*b* are arranged above the knitting needles 34*b*, specifically opposite to the direction in which the warp yarns 40*b* are supplied to the knitting point 52*b*. Moreover, the arrangement of the weft guide bars 44*b* and of the weft guides 48*b* is such that they lie along an arcuate path 86, along which the feeders 62*b* arranged on a feeder bar 64*b* also travel through the yarn guides 48*b* in a finger-like manner from the initial position A into the knitting position W.

The drive device 74*b* for the feeder bar 64*b* and for the feeders 62*b* is designed in such a way that the return travel 75*b* for the fork-shaped head 66*b* of the feeders 62*b* lies outside the weft guides 48*b*. For this purpose, the feeder bar 64*b* is fastened to a rocker lever 88 which rocks about the axis 90 which itself describes the eccentric travel 94 by means of a driven eccentric 92, with the result that the distance between the arcuate supply path 86 and the return travel 75*b* remote from this is determined by the weft guides 48*b*. The up-and-down movement is generated by an eccentric drive 96, the eccentric 98 of which is connected to a connecting rod 100, the other end of which is coupled to the rocker lever 88 via a joint 102.

LIST OF REFERENCE SYMBOLS

A Initial position 60 Gear
LS Long weft 61 Control device
K Warp 62 Feeder
S Stem 62*a* Feeder
W Knitting position 62*b* Feeder
32 Knock-over bar 64 Feeder bar
32*a* Knock-over bar 64*a* Feeder bar
2*b* Knock-over bar 64*b* Feeder bar
34 Knitting needle 66 Head, fork-shaped
34*a* Knitting needle 66*a* Head, fork-shaped
34*b* Knitting needle 66*b* Head, fork-shaped
36 Warp guide 68 Selvedge
36*a* Warp guide 68*a* Selvedge
36*b* Warp guide 70 Knitted fabric
38 Warp guide bar 70*a* Knitted fabric
38*a* Warp guide bar 70*b* Knitted fabric
38*b* Warp guide bar 72 Draw-off device
40 Warp yarn 72*a* Draw-off device
40*a* Warp yarn 74 Drive device
40*b* Warp yarn 74*b* Drive device
42 Carrier 75 Return travel
42*a* Carrier 75*b* Return travel
44 Weft guide bar 76 Knitting needle gap
44*a* Weft guide bar 78 Guide elevation
44*b* Weft guide bar 80 Panel holder
46 Guide 80*b* Panel holder
46*a* Guide 82 Guide clearance
48 Weft guide 82*b* Guide clearance
48*a* Weft guide 86 Path, arcuate
48*b* Weft guide 88 Rocker lever
50 Weft yarn 90 Axis
50*a* Weft yarn 92 Eccentric
50*b* Weft yarn 94 Eccentric travel
52 Knitting point 96 Eccentric drive
52*a* Knitting point 98 Eccentric
52*b* Knitting point 100 Connecting rod
54 Groove 102 Joint
56 Tongue
58 Actuator

What is claimed is:

1. A warp knitting machine comprising:

knitting needles;

a knock-over bar guiding said knitting needles thereon for movement along a respective knitting axis toward and away from a knitting point;

warp guide bars preceding said knitting needles, said warp guide bars including warp guides for providing warp yarns;

weft guide bars assigned to said weft needles, said weft guide bars including weft guides movable in a racking direction, wherein the paths of the weft guides of the weft guide bars do not cross through the knitting axis of the knitting needles; and feeders for feeding weft yarn to the knitting needles assigned to the weft guides, which feeders are guided and can be driven up and down along a feeder path, transversely to the racking direction of the weft guide bars, between the weft guides and the knitting needles, in such a way that the feeders lay racked weft yarns under the assigned knitting needles.

2. A warp knitting machine according to claim 1, wherein the weft guide bars together with the weft guides can be moved to and fro only in their racking direction.

3. A warp knitting machine according to claim 1, wherein the knitting needle is designed so as to be capable of being moved only along its knitting axis.

4. A warp knitting machine according to claim 1, wherein each knitting needle is assigned to a feeder.

5. A warp knitting machine according to claim 1, wherein the feeders cross through the paths of the weft guides of the weft guide bars and the axes of the knitting needles in a finger-like manner.

6. A warp knitting machine according to claim 1, wherein the feeders are arranged on a common drivable feeder bar.

7. A warp knitting machine according to claim 1, wherein the path of the feeder includes a return travel and the return travel of the feeder from the knitting point is arranged at a distance from the weft guides.

8. A warp knitting machine according to claim 1, wherein the weft guide bars together with the weft guides are arranged in such a way that the weft yarns are supplied to the knitting point by the weft guides essentially in the same direction as the warp yarns.

9. A warp knitting machine according to claim 1, wherein the weft guide bars together with the weft guides are arranged in such a way that the weft yarns are supplied to the knitting point by the weft guides in the opposite direction to the warp yarns.

10. A warp knitting machine according to claim 1, wherein the weft guides have mouths and the weft guide bars are arranged in such a way that the mouths of the weft guides are arranged along a straight or arcuate surface relative to the knitting point.

11. A warp knitting machine according to claim 1, wherein the feeders have a downwardly open fork-shaped head for grasping the weft yarns.

12. A warp knitting machine according to claim 1, including needle gaps defined between adjacent knitting needles and wherein the feeders have guide elevations on each of the two sides on a head engaging into the needle gap between the knitting needles.

13. A warp knitting machine according to claim 1, wherein knitting of the weft yarns and the warp yarns provides a knitted fabric having a selvedge and the feeders are designed in such a way that, after crossing through the axis of the knitting needles, they press the weft yarns onto the selvedge of the knitted fabric.

14. A warp knitting machine according to claim 1, wherein the magnitude of the up and down movement of the feeders is adjustable.

15. A warp knitting machine according to claim 1, wherein the warp knitting machine is a crochet gallooning machine.

* * * * *